US006367942B1

(12) United States Patent
Bauer

(10) Patent No.: US 6,367,942 B1
(45) Date of Patent: Apr. 9, 2002

(54) ROTATING CHEMILUMINESCENT FAN BLADE LIGHT DISPLAY

(76) Inventor: Scott Bauer, 1743 Plantation Cir. SE., Palm Bay, FL (US) 32909

( * ) Notice: Subject to any disclaimer, the term of this patent is extended or adjusted under 35 U.S.C. 154(b) by 0 days.

(21) Appl. No.: 09/498,976

(22) Filed: Feb. 7, 2000

(51) Int. Cl.[7] ..... F21K 2/00
(52) U.S. Cl. ..... 362/34; 362/96; 362/234; 362/35
(58) Field of Search ..... 362/34, 96, 234, 362/35

(56) References Cited

U.S. PATENT DOCUMENTS 5,380,156 A * 1/1995 Icovino ..... 416/5
6,175,354 B1 * 1/2001 Bissett et al. ..... 345/110

* cited by examiner

*Primary Examiner*—Sandra O'Shea
*Assistant Examiner*—Ali Alavi

(57) ABSTRACT

Due to the persistence of human vision, moving light sources tend to be perceived not as point sources, but as continuous streaks or arcs of light. Many toys, novelty items, and light show devices make use of this peculiarity of human vision by moving light sources to produce visually striking patterns of light and color. In addition to dedicated devices for this purpose, inventive minds have employed simple household devices such as fans to produce the movement necessary to provide an interesting light show. In the past, these have all relied on electrically operated lights. Unfortunately, complications arise in designing and implementing a means to provide electrical power from a stationary power source to electric lights attached to moving fan blades. Further complications arise in trying to adapt this design to fans of different configurations, sizes, and shapes. Most of the types of light displays utilizing fans for movement of the light sources in space are only applicable to a single model or brand of fan and require extensive modification and much technical skill to install them.

The invention described herein solves these problems by demonstrating a method for attaching chemiluminescent light sources to the blades or rotating structure of a fan to impart the required movement of the light sources in space. Because the light sources are chemiluminescent and require no electricity to emit light, no electrical connections between rotating blades and stationary power sources are required. Additionally, because the described attachment system conforms to fan blades of any shape, size, or configuration, the chemiluminescent light show may be utilized on virtually any available fan without resorting to the prior requirement of installing special blades.

Once the chemiluminescent light source attachment system has been installed on the blades or rotating structure of the fan, the light show that results from rotating the light sources may be easily altered by simply relocating the light sources to different points on the fan blade. The relocation of light sources on the rotating blades or changing the speed of the fan can change the perceived patterns of light in dramatic and surprising ways. In the preferred method of attachment described herein, the relocation of chemiluminescent objects on the fan blades may be done quite easily in seconds. In similar fashion, changing the color, shape, or intensity of the attached chemiluminescent light sources will also cause dramatic changes in the perceived light display. Chemiluminescent light emitting sources are readily available in a wide variety of shapes and colors. These include light sticks in various lengths and diameters, necklaces in varying lengths, bracelets, key chains, swizzle sticks, pendants, ear rings, buttons, and balls. The described invention herein allows attachment of any of these different shape chemiluminescent objects to virtually any location on a fan blade. This results in the ability to create a nearly infinite number of colored light and pattern displays and allows the user to easily produce his or her own custom light show.

3 Claims, 3 Drawing Sheets

ROTATING CHEMILUMINESCENT FAN BLADE LIGHT DISPLAY

REFERENCES CITED

| | | | |
|---|---|---|---|
| 5,437,540 | Aug. 1, 1995 | Blocker | Illuminated blade ceiling fan apparatus. |
| 5,028,206 | Jul. 2, 1991 | Kendregan | Illuminated ceiling fan. |
| 5,082,422 | Jan. 21, 1992 | Wang | Illuminative fan. |
| 5,609,509 | Mar. 11, 1997 | Stamos | Amusement and recreational apparatus. |
| 5,474,482 | Dec. 12, 1995 | Davidson | Aerodynamic rotor with chemiluminescent light source holder. |
| 5,882,239 | Mar. 16, 1999 | Trichak | Illuminatable aerodynamic disc or saucer. |
| 4,916,581 | Apr. 10, 1990 | Authier | Rotor blade illumination device. |
| 4,338,547 | Jul. 6, 1982 | McCaslin | Apparatus and method of generating light designs. |
| 4,298,868 | Nov. 3, 1981 | Spurgeon | Electronic display apparatus. |
| 5,041,947 | Aug. 20, 1991 | Yuen | Display device. |
| 5,269,719 | Dec. 14, 1993 | Klawitter | Light show mechanism. |
| 4,097,917 | Jun. 27, 1979 | McCaslin | Rotatable light display. |

STATEMENT REGARDING FEDERALLY SPONSERED RESEARCH OR DEVELOPMENT

Not Applicable

REFERENCE TO MICROFICHE APPENDIX

Not Applicable

BACKGROUND OF THE INVENTION

Due to the persistence of human vision, moving light sources tend to be perceived not as point sources, but as continuous streaks or arcs of light. Many toys, novelty items, and light show devices make use of this peculiarity of human vision by moving or rotating light sources to produce visually striking patterns of light and color. Many inventors have recognized this effect and made use of it in a variety of ways. Most of these involve dedicated devices utilizing electric lights which are moved or rotated in predetermined patterns. Examples of such devices are described in U.S. Pat. No. 4,338,547 by McCaslin, U.S. Pat. No. 4,298,868 by Spurgeon, U.S. Pat. No. 5,041,947 by Yuen, U.S. Pat. No. 5,269,719 by Klawitter, and U.S. Pat. No. 4,097,917 by McCaslin. All of these patents describe machines dedicated to the creation of light show displays. Unfortunately, many of these devices are quite complicated and therefore too costly for the average consumer to justify their use.

Also in evidence in the patent literature are a number of toys that utilize the principles of moving light to create entertaining displays or enhance visibility at night. These are simpler devices and avoid the complications of transferring electric power to the rotating lights by utilizing chemiluminescent light sources. Examples of this type of device are described in U.S. Pat. No. 5,609,509 by Stamos where he describes a rotating hand toy utilizing whirling chemiluminescent tubes to create the visual effect, U.S. Pat. No. 5,474,482 by Davidson where he describes a flying aerodynamic rotor containing a chemiluminescent light source which both provides a pleasing light display and aids in night time visibility of the toy, and U.S. Pat. No. 5,882,239 by Trichak who describes a flying disk lighted with chemiluminescent materials. While these toys incorporate chemiluminescent light objects to provide the moving light display, they are devices that are specific to certain types of toys and their application is mostly limited to outdoor activities.

Incorporation of light sources into the rotating blades of a fan is known to provide a pleasing display of light patterns and colors. Unfortunately, implementation of these lighted blades is generally difficult and involves complex wiring and slip ring means to transfer electrical energy to the lamps mounted on rotating blades. The present invention provides a means for creating a striking light display mounted on rotating fan blades without the complication of electrical connections by utilizing chemiluminescent light sources attached to the rotating fan blades. The use of chemiluminescent light sources totally eliminates the need for any electrical connections to the rotating blades of the fan. The present invention also differs from previous illuminated blade devices by allowing the user to easily change the color, pattern, or intensity of the rotating display by changing the color, shape, number, or intensity of the attached chemiluminescent devices.

Prior implementations of lighted fan blades as described in U.S. Pat. Nos. 5,437,540, and 5,028,206, and 5,082,422, required production of specialized blades containing electrically operated light elements. These prior applications also required the additional mounting of specialized means to transfer electrical energy to the rotating lighted blades. The present invention eliminates all of these problems by allowing the user to utilize the original manufacturer's fan blades and electrical system, without modification, other than the simple addition of a means to attach chemiluminescent devices to the existing blades. No prior art was found where the inventor attached chemiluminescent devices to rotating fan blades except for one by Authier, U.S. Pat. No. 4,916,581, wherein a chemiluminescent light stick was incorporated into the tip of a helicopter rotor blade to aid the pilot in visualizing the location of his rotor blade tips at night. The present invention described herein is different in that it does not apply to the rotating blades of helicopters or other aircraft.

BRIEF SUMMARY OF THE INVENTION

The present invention provides a means for creating a striking light display through the attachment of one or more chemiluminescent light sources to one or more of the rotating blades of a fan. Any type of fan may be used, however, this display is particularly striking when the chemiluminescent light sources are attached to a ceiling fan. The composition of the light show may be easily changed by the user by simply changing the color, shape, number, or position of the chemiluminescent light sources on the fan blades.

One advantage of the present invention is that no electrical or mechanical modification of the fan is necessary. Where prior implementations of lighted fan blades required specialized design of fan blades and electrical transfer mechanisms that are specific only to one brand or model of fan, the invention described herein, particularly the preferred implementation described in the enclosed description and drawings, is applicable to all brands and models of fans.

Another advantage of the present invention is that the composition of the resulting light show may be altered in a nearly infinite manner through user selection of chemiluminescent light source shapes, sizes, intensity, colors, and positioning of those light sources on the fan blade. The present invention allows the user to customize the light display to suit his or her mood, tastes in color, or preference in pattern easily and in a non-permanent manner. The appearance of the light display may be changed at will to match the user's changing mood or preferences.

Another advantage of the present invention is that it provides a source of entertainment through the ability to easily change the appearance of the light show simply by moving the chemiluminescent light sources around on the fan blades. This provides for hours of fun and the possibility for competitions to see who, among the viewers, can create the most striking light display through manipulation of the positions and combinations of shapes and sizes of chemiluminescent light sources attached to the blades.

Another advantage of the present invention is that it allows easy installation in night clubs, discos, restaurants, or concert halls to provide an easily changed display of pleasing light without the costs associated with traditional electrical lighting displays and specialized electronic control systems.

Another advantage of the present invention is that the air circulating function of the fan is retained.

Another advantage of the present invention is that it may be installed easily, in minutes, by users who may have limited mechanical and/or electrical skills.

Therefore, it is an object of the present invention to provide a new and improved method for producing a rotating light show, without the need for cumbersome electrical connections or apparatus, by attaching chemiluminescent light sources, of a type, size, color, or intensity, selected by the user, to the blades of an existing fan.

It is further an object of the present invention to provide a preferred means of attachment of the chemiluminescent light sources to the fan blades which is easy to install and allows for easy alteration of the light display by allowing the user to change the position, color, intensity, or type of chemiluminescent light source attached to the blades of the fan.

DETAILED DESCRIPTION OF THE INVENTION

From an overview standpoint, the invention comprises the attachment of chemiluminescent light sources to the rotating blades of a fan for the purpose of producing an entertaining and/or attention grabbing light show.

Figure 1:
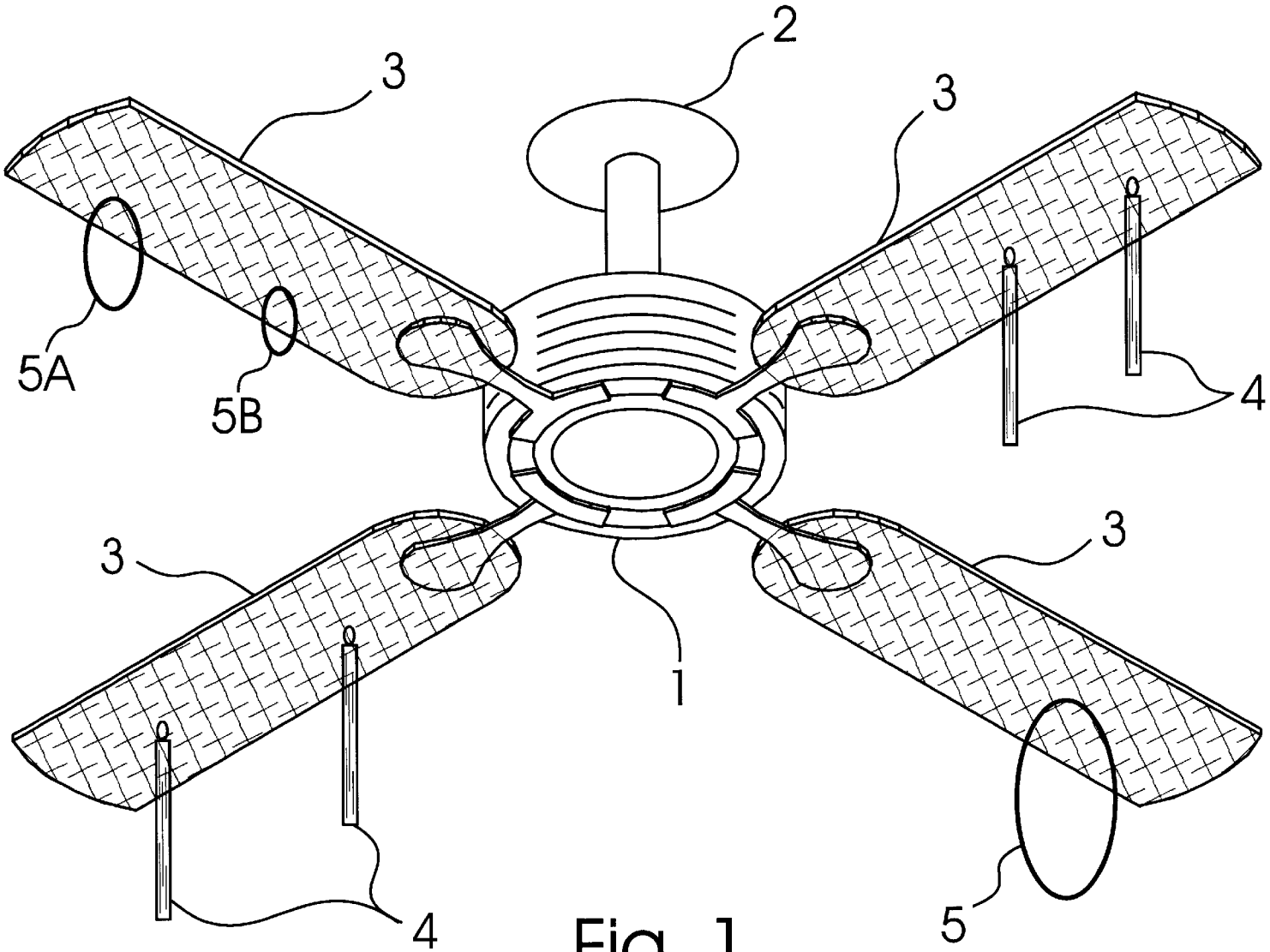
FIG. 1 is a perspective view of a ceiling fan with a variety of chemiluminescent light sources attached to the blades. Shown are chemiluminescent light sticks (4), necklaces (5), bracelets **(5*a*) and ear rings (5*b*)**.

FIG. 1 shows a ceiling fan to which a variety of chemiluminescent devices have been attached. The fan motor (1), held by a mounting means (2), turns the blades (3) causing the chemiluminescent light sources **(4,5,5*a*,5*b*) to sweep out circles in space. Due to the persistence of human vision, these light sources may appear as continuous circles or arcs, depending on the fan speed. By positioning the chemiluminescent light sources at varying locations on the fan blades, different mixtures of colors and shapes may be scribed in space causing a pleasing visual display. Positioning light sources so they overlap, utilizing different size chemiluminescent light sticks (4), and/or utilizing different shape items such as necklaces (5), bracelets (5*a*), ear rings (5*b*)**, balls, or other shaped items will produce dramatic changes in the perceived light patterns, colors, and intensities.

Figure 2:
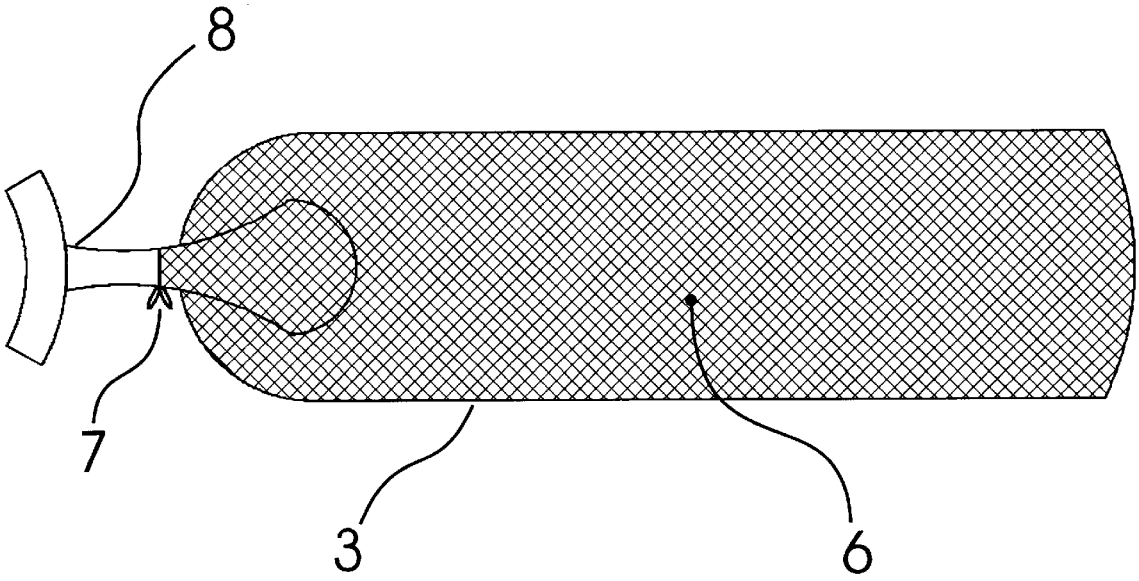
FIG. 2 is a detail view of a fan blade covered with an elastic mesh bag (6) from which a wide variety of chemiluminescent light sources may be hung to create a user defined light display.

The preferred means of attachment of the chemiluminescent light sources is detailed in FIG. 2. Referring to FIG. 2, there is shown a ceiling fan blade (3) and mounting arm (8) covered by an elastic mesh bag (6) which is stretched over the blade and tied closed around the root of the blade (7) to keep it in place against the centrifugal forces that occur during blade rotation. Excess material remaining after stretching the bag over shorter fan blades may be cut off to provide an aerodynamic and unobtrusive installation. In the preferred implementation, this elastic mesh bag (6) is constructed of a material similar to that used in the manufacture of women's fishnet stockings. The elastic quality of the mesh allows it to conform snugly to the shape of the blade and allows for installation of the mesh bag (6) on fan blades of varying width, length, and shape in a secure manner. The mesh bag (6) conforms to the shape and size of the blade to provide minimal alteration of the air circulation qualities of the blade and also eliminates potential hazards that may be encountered from loose fitting attachments snagging on stationary portions of the fan while the blade is rotating.

The elastic mesh bag (6) provides a lattice work support for the attachment of a variety of chemiluminescent light sources at any location on the fan blade as illustrated in FIG. 1. This is the preferred light source mounting method as the mesh provides a large number of mounting points on all surfaces above, below, or at the edges of the blades. This allows the user the most latitude in designing a personalized rotating display. Although the illustrations demonstrate installation on a ceiling fan, the elastic quality of the mesh bags allows installation on any type of fan.

Figure 3:
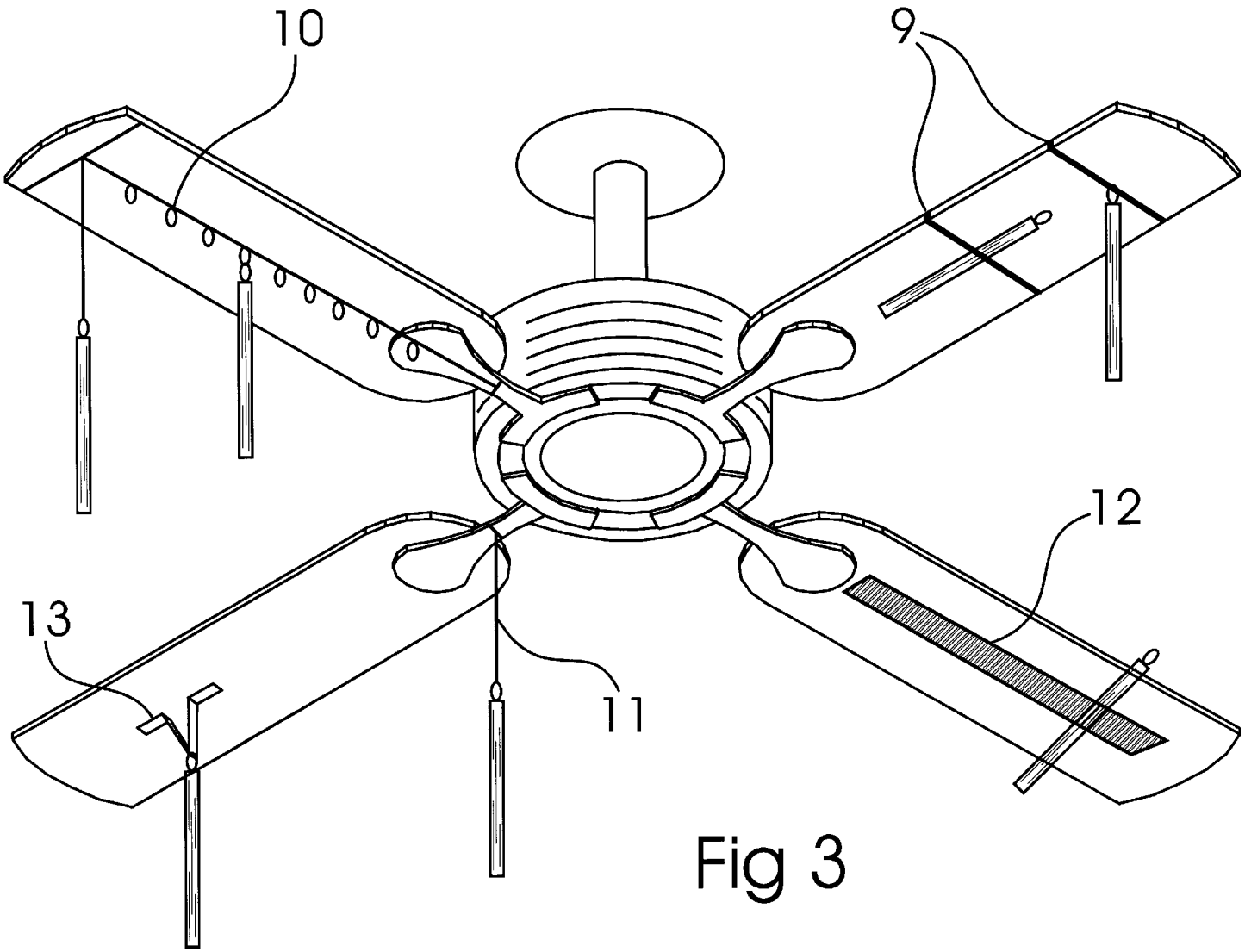
FIG. 3 shows a fan that illustrates some of the alternate means of attachment of chemiluminescent light sources to the blades of a fan that have been conceived and tested by the inventors. These include rubber rings (9), loop ladders (10), strings (11), hook and loop fabric tape or adhesive tape (12), and stand-off brackets (13).

Numerous methods of attaching these chemiluminescent light sources to the fan blades will undoubtedly occur to those skilled in the art. The preceding descriptions and drawings are intended to illustrate the preferred methodology for attachment of the chemiluminescent light sources to rotating fan blades to provide the broadest possible latitude in user defined position and type of chemiluminescent light source used to create the resulting light display. These descriptions and diagrams are illustrative only of the principles of the invention. It is not desired to limit the invention to the exact construction and operation shown and described, and accordingly, all suitable modifications and equivalents that may be resorted to for the purpose of attaching chemiluminescent light sources to fan blades fall within the scope of the invention. Examples of alternative chemiluminescent light source mounting means that have occurred to, and been tested by, the inventor are shown in FIG. 3. These means include rubber rings (9), loop ladders (10), strings (11), hook and loop fabric tape or adhesive tape (12). The use of stand-off brackets (13) to provide a more three dimensional character to the light display was also demonstrated. Although the invention is described in its preferred forms with a certain degree of particularity, it is understood that the present disclosure of the preferred form has been made only by way of example and numerous changes in the details of construction and combination and arrangement of parts may be resorted to without departing from the spirit and scope of the invention. Furthermore, the illustrations and text refer to the use of a ceiling fan to produce movement required for the light show although any type of fan will produce pleasing results.

What is being claimed as new and desired to be protected under patent of the United States is as follows:

1. An apparatus consisting of chemiluminescent light emitting sources, a fan, and a means for attaching said chemiluminescent light emitting sources to the blades or rotating structure of the fan for the purpose of producing a rotating light display; wherein the attached chemiluminescent light emitting sources are singly, or in combination selected from different shapes, sizes, intensities, and colors of chemiluminescent light sticks, necklaces, bracelets, key chains, swizzle sticks, pendants, ear rings, buttons, and balls.

2. The apparatus of claim 1 wherein the chemiluminescent light emitting sources are attached directly to or suspended directly from the blades or the rotating structure of the fan.

3. The apparatus of claim 1 wherein the chemiluminescent light emitting sources are attached to, or suspended from supporting structures such as nets, rubber bands, strings, adhesive tape, or brackets which in turn attached to the blades, or rotating structure of the fan.

* * * * *